US006926063B1

(12) United States Patent
Eirich et al.

(10) Patent No.: US 6,926,063 B1
(45) Date of Patent: Aug. 9, 2005

(54) METHOD FOR CONDITIONING FOUNDRY MOULDING SAND AND A DEVICE THEREFOR

(75) Inventors: Paul Eirich, Hardheim (DE); Hubert Eirich, Hardheim (DE); Walter Eirich, Hardheim (DE)

(73) Assignee: Maschinenfabrik Gustav Eirich, (DE)

( * ) Notice: Subject to any disclaimer, the term of this patent is extended or adjusted under 35 U.S.C. 154(b) by 126 days.

(21) Appl. No.: 10/088,888

(22) PCT Filed: Sep. 6, 2000

(86) PCT No.: PCT/DE00/03117

§ 371 (c)(1),
(2), (4) Date: Jul. 29, 2002

(87) PCT Pub. No.: WO01/21341

PCT Pub. Date: Mar. 29, 2001

(30) Foreign Application Priority Data

Sep. 23, 1999 (DE) ..... 199 45 569

(51) Int. Cl.[7] ..... B22C 5/18; B01F 13/06; B01F 15/02; B01F 15/06

(52) U.S. Cl. ..... 164/5; 366/139; 366/147; 366/170.1; 366/170.3

(58) Field of Search ..... 366/2–4, 7, 22–25, 366/64–67, 139, 147, 170.1, 170.3; 164/5

(56) References Cited

U.S. PATENT DOCUMENTS 2,456,769 A * 12/1948 Christensen et al. ..... 134/2
2,593,327 A * 4/1952 McIlvaine ..... 366/13
2,618,471 A * 11/1952 Weigham et al. ..... 366/99

(Continued)

FOREIGN PATENT DOCUMENTS

DE 2952403 A * 7/1981

(Continued)

OTHER PUBLICATIONS

Diem, Winfried, "Moderne Anlagen zur Aufbereitung von Formsand", Giesserei-Erfahrungsaustausch, pp 475-481, Nov. 1998.

*Primary Examiner*—Charles E. Cooley
(74) *Attorney, Agent, or Firm*—Michael L. Dunn

(57) ABSTRACT

A method for conditioning cooled used moulding sand retaining moulding sand binder in a mixer (1), wherein the cooled used moulding sand is heated to at least a minimum temperature, moisturized by providing water or water vapor through holes in an agitator and subsequently cooled in the mixer from the minimum temperature using the effect of a vacuum. The invention also includes an apparatus for practicing the method which includes a mixing container, a rotatable mixing agitator and a mixing agitator drive suitable for mixing moulding sand in the mixing container, apparatus for feeding components to be mixed to the mixer, apparatus for supplying hot water or hot water vapour to components in the mixing chamber through a plurality of holes in the agitator facing away from a direction of rotation of the agitator, apparatus for stopping the flows of hot water and vapour to the mixing chamber, apparatus for vacuum sealing the mixing container, apparatus for providing a vacuum in the mixing chamber after the flows are stopped to cool the contents of the mixing chamber and remove moisture by vacuum evaporation, and apparatus for removing mixed components from the mixing chamber.

22 Claims, 2 Drawing Sheets

U.S. PATENT DOCUMENTS

| | | | | | |
|---|---|---|---|---|---|
| 2,628,080 | A | * | 2/1953 | Mack | 366/139 |
| 3,521,863 | A | * | 7/1970 | Graham | 366/139 |
| 3,690,622 | A | * | 9/1972 | Brunner et al. | 366/52 |
| 4,249,828 | A | * | 2/1981 | Condolios | 366/102 |
| 4,681,267 | A | * | 7/1987 | Leidel et al. | 241/14 |
| 4,709,862 | A | * | 12/1987 | Leidel | 241/15 |
| 4,772,434 | A | * | 9/1988 | Myers | 264/8 |
| 5,152,212 | A | * | 10/1992 | Chauveau | 99/348 |
| 5,279,741 | A | * | 1/1994 | Schott | 210/634 |
| 5,284,085 | A | * | 2/1994 | Palm | 99/348 |
| 5,603,567 | A | * | 2/1997 | Peacock | 366/139 |
| 5,626,421 | A | * | 5/1997 | Campbell | 366/147 |
| 5,816,312 | A | * | 10/1998 | Suginaka et al. | 164/456 |
| 5,915,833 | A | * | 6/1999 | Kruse | 366/7 |
| 6,030,111 | A | * | 2/2000 | Tokuyoshi et al. | 366/2 |
| 6,860,313 | B2 | * | 3/2005 | Greissing et al. | 366/139 |
| 2003/0079851 | A1 | * | 5/2003 | Jo | 164/5 |

FOREIGN PATENT DOCUMENTS

| | | | | |
|---|---|---|---|---|
| DE | 4190731 | | | 2/1993 |
| DE | 4411201 | A | * | 10/1995 |
| DE | 19536803 | A | * | 4/1996 |
| EP | 0736349 | B | * | 10/1995 |
| GB | 2066683 | | * | 7/1981 |

* cited by examiner

METHOD FOR CONDITIONING FOUNDRY MOULDING SAND AND A DEVICE THEREFOR

BACKGROUND OF THE INVENTION

1. Field of the Invention

The invention relates to a method for conditioning of moulding sand, wherein the conditioning takes place at least in part in a vacuum. The present invention furthermore relates to a device for implementing the method.

2. Background Art

The conditioning of sand for producing casting moulds is intended to produce the correct mixture ratio of grain sizes as well as the ratio of amounts of quartz sand, binder, powdered coal and used and new sand, to homogenise the mixture and thus to largely coat the grain with the binder, to regulate the correct moisture content, to remove unwanted components, to regulate the correct temperature of the moulding sand, and lastly to transport the ready, conditioned sand to where it is to be used.

In general, the used sand has a raised temperature of, for example, between 100° C. and 140° C. As sand temperatures over approximately 50° C. can present significant problems for moulding machines, and at too high temperatures variations in moisture in the finished sand occur because of uncontrollable evaporation losses on the way between the mixer and moulding installation, in this case the sand has to be cooled.

For this, fluidised bed coolers are mostly used that the sand continuously passes through by means of oscillatory movements of a sieve grate. The cooling principle is that water sprayed onto the sand with nozzles evaporates, and the evaporation enthalpy necessary for this is drawn from the sand as sensible heat. The disadvantage of the method is, however, that very large amounts of air are necessary for transporting away the water vapour occurring, which in turn requires additional energy use.

In DE 29 52 403 C2 therefore, an alternative cooling method was developed. In accordance with this, simultaneous conditioning and cooling of clay bonded foundry moulding sands takes place in a vacuum mixer. The individual components are firstly placed in the mixer.

After a brief pre-homogenisation the temperature and moisture of the mixture is determined and the required amount of water added. Lastly, during the conditioning process, the pressure in the mixer is gradually lowered. As soon as the pressure corresponding to the vapour pressure curve of water is reached, the water in the sand begins to boil and draws the evaporation heat necessary for this from the sand. In this way extremely effective cooling is obtained inexpensively.

The cooler of DE 29 52 403 C2 is only usefully employed when used sand is returned to the mixer at a temperature such that cooling is necessary.

After longer breaks in operation, for example at weekends or due to a breakdown, or where there is low thermal stressing of the moulding sand, for example, because of varying casting temperatures or varying cooling times for the cast shape, the low temperatures of the used sand temperatures do not necessitate cooling. In such cases the moulding sand mixer is operated without the vacuum. Even when used sand is expensively conditioned without a vacuum, it nevertheless differs from moulding sand that has been conditioned using a vacuum.

It is highly desirably in all foundries that the characteristics of the sand are kept as constant as possible in order to obtain consistent quality of the products of the moulding installation.

BRIEF DESCRIPTIONS OF THE INVENTION

The object of the present invention is thus to provide a method and a device that ensure conditioning of the moulding sand in a vacuum regardless of the temperature of the used sand, provides a cooled moulding sand for further processing, and wherein the re-conditioned moulding sand attains constantly high quality values regardless of the temperature of the moulding sand.

This object is solved in accordance with the invention in that moulding sand not cooled down in a vacuum is heated before conditioning or during conditioning and subsequently cooled using the effect of the vacuum.

Prior heating ensures that even used sand that is already cooled can be conditioned with the aid of the vacuum technique.

It has however been shown in an unexpected manner that the addition of moisture and heat, in particular in the form of condensed vapour, and subsequent cooling and removal again of the moisture by evaporation in a vacuum leads to a qualitatively significantly better moulding sand than the direct use of cooled sand, possibly with moisture correction. Thus, by means of vacuum treatment of the moulding sand, in addition to the advantageous cooling effect, more advantageous quality characteristics of the conditioned moulding sand are obtained. Thus, for example, flow capability, gas permeability and moulding stability of the moulding sand prepared in a vacuum are demonstrably increased.

In accordance with the invention a method is therefore provided for conditioning cooled used moulding sand retaining moulding sand binder in a mixer (1), wherein the cooled used moulding sand is heated to at least a minimum temperature, moisturized by providing water or water vapor through holes in an agitator and subsequently cooled in the mixer from the minimum temperature using the effect of a vacuum.

Further, an apparatus is provided for practicing the method which includes a rotatable mixing container 15, having a rotating motor 22, a rotatable mixing agitator 18 and a mixing agitator drive 23 suitable for mixing moulding sand in the mixing container, apparatus 2, 3, 13 and 14 for feeding components to be mixed to the mixer, apparatus 8, 12 for supplying hot water or hot water vapour to components in the mixing chamber through a plurality of holes 19 in the agitator facing away from a direction of rotation of the agitator, apparatus 4, 12 for stopping the flows of hot water and vapour to the mixing chamber, apparatus 16 for vacuum sealing the mixing container, apparatus 9 for providing a vacuum in the mixing chamber after the flows are stopped to cool the contents of the mixing chamber and remove moisture by vacuum evaporation, and apparatus 17 for removing mixed components from the mixing chamber.

DETAILED DESCRIPTION OF THE INVENTION

Figure 1:
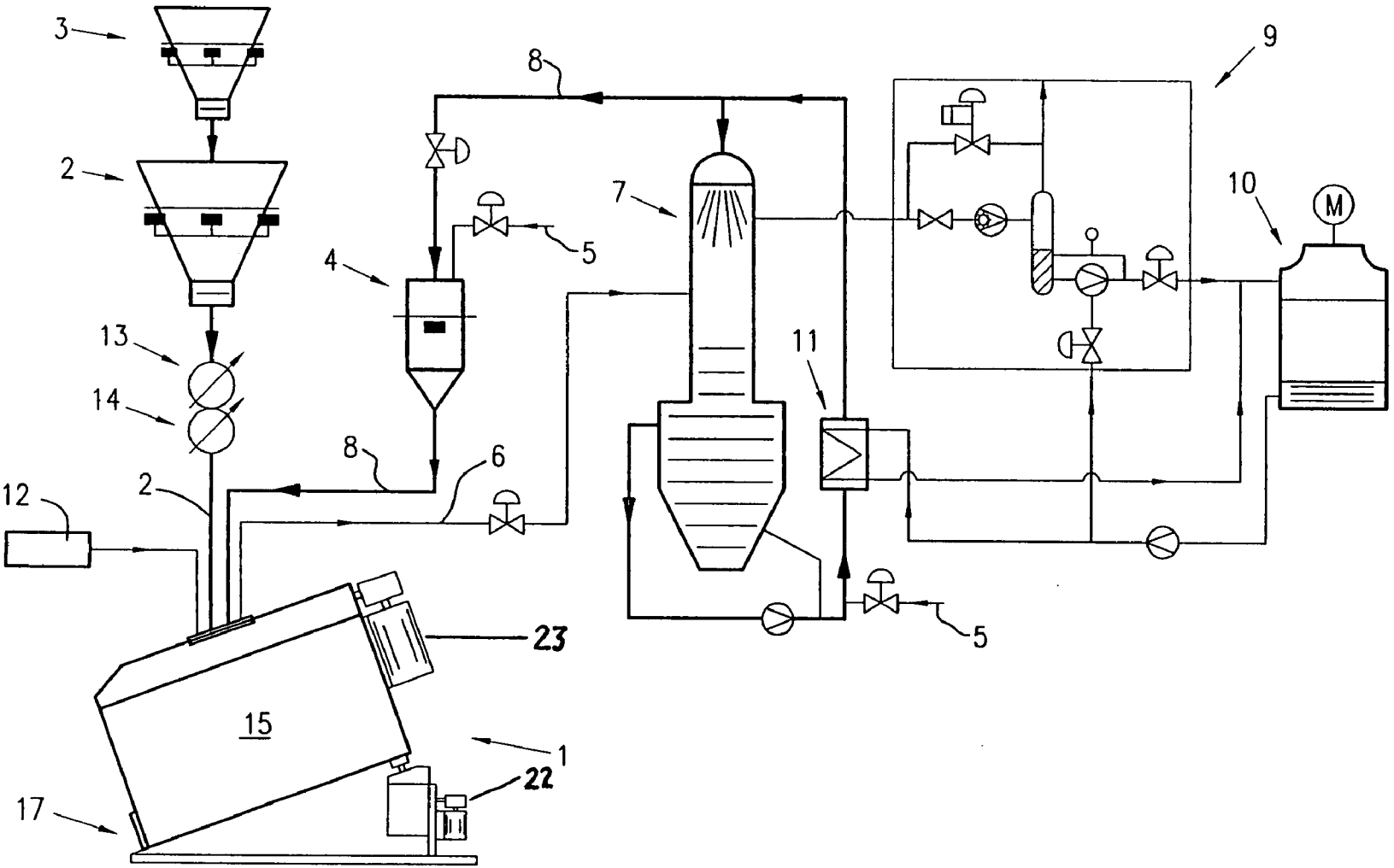
FIG. 1 shows a schematic diagram of a method of the invention.
Figure 2:
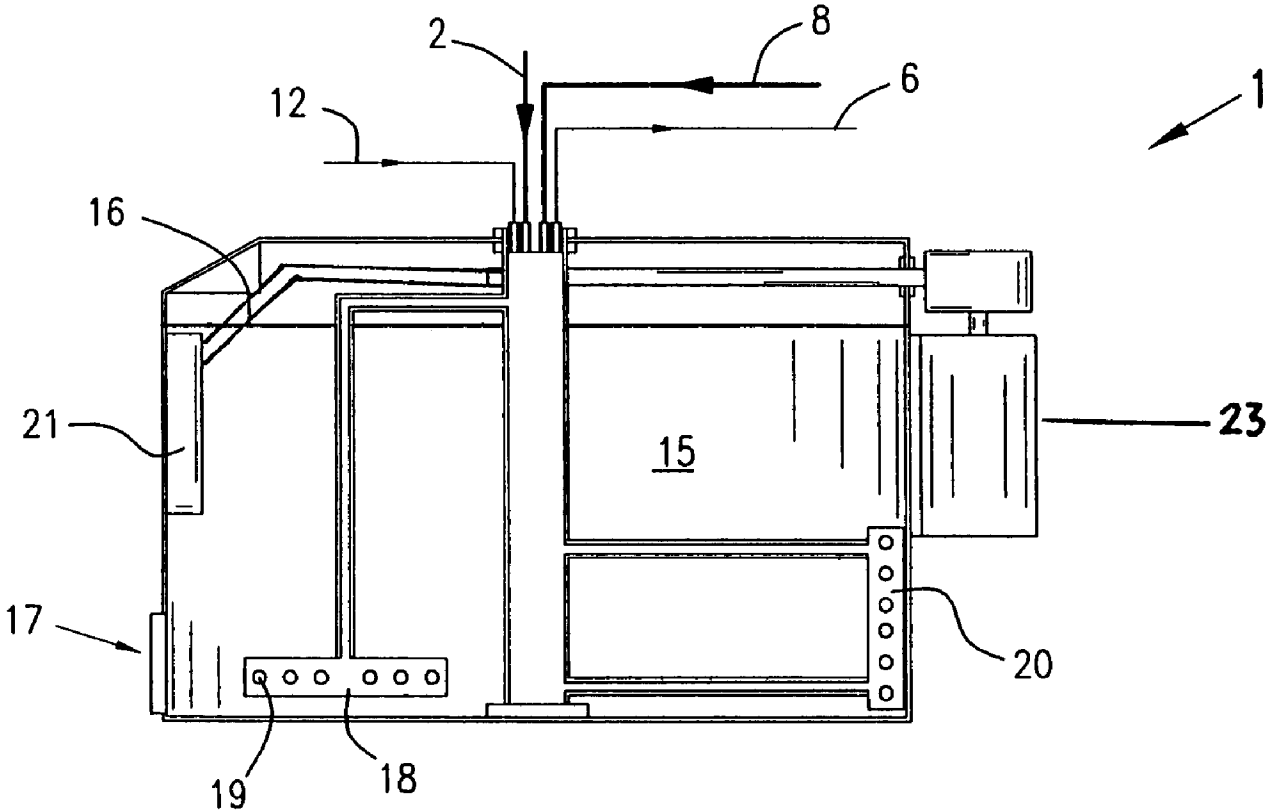
FIG. 2 shows an expanded cross sectional view of a mixer apparatus for use in accordance with the invention.

An embodiment is particularly preferred in which a minimum temperature $T_{min}$ is pre-determined and the temperature of the moulding sand $T_{ist}$ is determined and the moulding sand is heated when the temperature of the moulding sand is less than the pre-determined minimum temperature ($T_{ist}<T_{min}$).

In this way it is ensured that the moulding sand is not heated when it is already at a sufficiently high temperature. In this way it is possible to keep the energy use as low as possible. On the other hand, the temperature of the moulding sand is advantageously regulated as exactly as possible to the temperature $T_{min}$ so that conditioning can take place under consistent conditions, and the conditioned sand has a consistent, extremely high quality.

The measurement of temperature and/or moisture can selectively be done with the used sand delivery or in the mixer by means of suitable probes.

In this way it is possible to heat the sand both before it is put into the mixer as well as in the mixer. The heating of the moulding sand can be done, for example, with the aid of moisture-saturated hot air, heat radiation or microwaves.

Preferred embodiments of the present invention, however, provide that the moulding sand is heated by the addition of hot water and/or by hot water vapour.

In a particularly preferred embodiment of the method according to the invention, temperature measurement of the used sand is done ahead of or in the mixer. If the temperature sensed is above the minimum temperature set for vacuum cooling, the conditioning and cooling of the sand take place in the known manner. If, however, the temperature of the used sand is below the set minimum temperature, preferably hot vapour is blown into the cold moulding sand. This vapour condenses in the mixer and thereby heats the moulding sand to the desired minimum temperature. As soon as the set temperature is reached, the supply of vapour is stopped and the moulding sand is cooled to the desired final temperature by application of a vacuum.

For reasons of cost, the amount of hot vapour added is preferably kept low.

As already described in the introduction, a certain minimum moisture content of the used sand is necessary so that the conditioned moulding sand attains the final moisture and is provided with sufficient malleability. A particularly advantageous embodiment of the present invention provides that if the temperature difference between the temperature of the used sand and the set minimum temperature is so small that amount of water condensed in the sand by the addition of hot vapour is not sufficient to provide the moulding sand with the desired final moisture, processing water is also added to the moulding sand in addition to the water vapour.

Under certain conditions it is sufficient when hot water alone is added in order to obtain the desired heating.

Where, after cooling, the final moisture in the moulding sand is too great, evaporation in a vacuum is continued until the desired final moisture is obtained.

Even where the addition of the hot vapour to the moulding sand preferably takes place within the mixer, the addition of the hot vapour to the transport or storage area or also in the debris pile is possible. The addition of vapour in the mixer has the advantage that portions of the mix wetted with vapour are continuously in motion and therefore reliably come into contact with the portions that are not yet wetted. As a result the mix mixes well with the water vapour.

By conditioning the sand in a vapour atmosphere, the clay binder, usually bentonite, is clearly better penetrated and activated by the water. Because of the better penetration of the binder with water a more even distribution of moisture is produced in the binder covering, and as a result of this better flow capability of the moulding sand when the mould is filled.

Where the addition of the vapour is done into the pile of sand debris, it is particularly advantageous for the hot vapour to be added via an injecting lance that ends as deeply as possible inside the layer of sand so that the hot vapour condenses completely in the sand without losses.

Where the addition of vapour is into the mixer, alternatively a hollow shaft or another machine part extending into the mixture, for example, a wall scraper 20, is configured hollow to be used as an injection lance. When the vapour is added via the hollow shaft of the mixing apparatus having a container 15 and an agitator 18, it is recommended that the outlets 19 of the vapour be arranged such that they open out to the rear (as seen in the direction of rotation) of the mixing fins or blades. Agitator 18 is driven by drive 23. Alternatively vapour may be added to the mixer through a baffle 21.

When moulding sand is mixed using non-rotary mixing containers, the addition of vapour is preferably done through a side opening 17 in the lower wall area of the mixing container. The side opening 17 allows removal of mixed components.

In a preferred embodiment, the moisture content and the temperature of the used sand is measured and compared to the pre-determined reference values for the finished sand. From this the amount of water is calculated, and added, that is necessary for cooling and moistening the moulding sand.

Preferably the amount of vapour necessary for heating is also determined by comparing the input temperature with the pre-determined minimum temperature. Where the amount of vapour to be provided is insufficient to obtain the desired moisture content in the finished sand, processing water is also added.

An alternative possibility for determining the amount of vapour to be added is that before or during the addition of vapour into the mixer, a pressure is set whereby the boiling temperature of the water corresponds to the desired final temperature. Vapour is added until the pressure or the temperature of the water-vapour mixture above the mix increases. The water vapour added condenses in the mix so long as the temperature of the mix is below the desired minimum temperature. When the temperature of the moulding sand reaches the minimum temperature, the condensation process ends and the vapour pressure above the mix increases. This vapour pressure can be determined. The abrupt increase in the vapour pressure is then an indicator that sufficient hot vapour has been supplied.

The increase in the vapour pressure can be rather indistinct, however, particularly in the case of large-diameter vacuum pumps. In this case it is advantageous to measure the temperature of the vapour that generally to passes via a drain to a condenser. When the condensation process stops in the mix, the temperature in the drain greatly increases. This can also serve as an indicator that sufficient water vapour has been put into the mix.

In this case, the amount of water required for the malleability of the sand or respectively for the desired moisture content must be determined separately.

A particularly energy-saving embodiment of the present invention provides that, where necessary, heating of the moulding sand is done by suitable mixing with hot used sand. It is thus possible, for example, that hot used sand is stored in a silo, and where necessary mixed with cold used sand so that the temperature of the used sand mixture is increased to the minimum temperature and consequently only a small amount, or even no heating by adding vapour or hot water is necessary.

Further advantages, features and possibilities for application will become evident from the following description of a preferred embodiment with reference to the attached drawing.

In FIG. 1 the mixer 1 is clearly shown at the bottom left. Used, and possibly also new sand is added at 2, and as required mixed with filter dust, bentonite and powdered coal 3. The temperature $T_{ist}$ and the moisture content of the used sand are determined by the temperature sensor 13 and the moisture sensor 14 prior to said used sand being placed in the mixer 1.

A programmable control system (not shown) compares the temperature $T_{ist}$ with a pre-determined minimum temperature $T_{min}$. If the temperature of the used sand is below the pre-determined minimum temperature hot vapour is injected into the mixer via the vapour supply 12 until the mixture reaches the pre-determined minimum temperature. The amount to be supplied can be calculated, for example, from $T_{ist}$ (and naturally from the amount of mixture). Alternatively, a further temperature sensor can be arranged in the mixer, which sensor senses the temperature of the mix so that the addition of hot vapour can be stopped once the minimum temperature is reached. A further possibility for determining the amount of vapour to be supplied is in that a vacuum is created in the mix-cooler so that the (low) pressure set pushes the boiling temperature of water to the pre-determined minimum temperature. If water vapour is now supplied, it condenses in the mixture for as long as the temperature of the mixture is below the minimum temperature. As soon as the minimum temperature is reached the condensation process is stopped and the temperature of the gas (water vapour) pumped away by the line 6 abruptly increases from the minimum temperature to a greatly higher value, that substantially corresponds to the temperature of the water vapour supplied. To the extent that the temperature in the line 6 is sensed, the abrupt increase in temperature in the line 6 can be used as a signal to terminate the supply of vapour.

From the moisture content it is calculated whether the amount of vapour supplied is sufficient to give the moulding sand its desired final moisture. If this is not the case, fresh water 5 or circulation water 8 as processing water is supplied via the balance or metering apparatus 4.

After addition of hot vapour and possibly of the processing water, the pressure in the mix-cooler 1 having vacuum seal 16, is gradually reduced with the aid of the vacuum unit 9, until the boiling temperature of the water corresponds to the desired final temperature (for example, 30–40° C.). The water vapour condenses again and is fed via the line 6 to a condenser 7. Here, the water vapour condenses again and is fed again via the heat exchanger 11 into the circulation water. Another water circulation is responsible for cooling the vacuum unit 9 and the heat exchanger 11, and is provided for this purpose with a cooling tower 10.

What is claimed is:

1. A method for conditioning cooled used moulding sand retaining moulding sand binder in a mixer (1), wherein the cooled used moulding sand is heated to at least a minimum temperature, moisturized by providing water or water vapor through holes in an agitator and subsequently cooled in the mixer from the minimum temperature using the effect of a vacuum.

2. A method according to claim 1, wherein a desired minimum temperature $T_{min}$ is determined, the starting temperature $T_{ist}$ of the moulding sand is determined, and the moulding sand is heated when $T_{ist}<T_{min}$.

3. A method according to claim 1, wherein the cooled used moulding sand is heated before it is placed in the mixer (1).

4. A method according to claim 1, wherein the cooled used moulding sand is heated in combination with unused moulding sand to at least the minimum temperature in the mixer (1) prior to application of the vacuum.

5. A method according to claim 1, wherein the moulding sand is heated with the aid of hot air or microwaves.

6. A method according to claim 1, wherein the moulding sand is heated by addition of hot water.

7. A method according to claim 1, wherein the moulding sand is heated by addition of hot water vapour (12).

8. A method according to claim 7, wherein the temperature of the moulding sand is increased to at least the minimum temperature $T_{min}$ by addition of hot water vapour (12).

9. A method according to claim 8, wherein the moisture content of the moulding sand is sensed (14) enough water (4) is added as is necessary for cooling of the moulding sand in a vacuum and so that a quantity of water remains in the moulding sand for the moulding sand to obtain a desired moisture content in finished sand.

10. A method according to claim 7, wherein water in vapour or liquid form added for heating the moulding sand is at least in part additionally used for moistening the moulding sand.

11. A method according to claim 10, wherein excess water in the moulding sand is regulated by evaporation in a vacuum to a desired final moisture.

12. A method according to claim 7, wherein the amount of water vapour or water added to the moulding sand to heat it is determined dependent upon the temperature $T_{ist}$ of the moulding sand and the desired minimum temperature $T_{min}$.

13. A method according to claim 7, wherein the amount of water vapour added to the moulding sand to heat it is obtained by setting a pressure in the mixer such that a boiling temperature of the water at the set pressure corresponds to the desired minimum temperature, and water vapour is supplied until the pressure increases or the temperature in a suction line (6) shows an accelerated increase.

14. A method according to claim 1, wherein processing water (4) is added to obtain a desired minimum moisture.

15. A method according to claim 1, wherein hot water or hot water vapour is supplied to the mixer below the surface of the moulding sand to heat the sand to at least the minimum temperature.

16. A method according to claim 1, wherein moulding sand below the minimum temperature is heated by mixing with hot moulding sand.

17. A method according to claim 1, wherein the vacuum is below the vapor pressure of water.

18. Apparatus for conditioning moulding sand comprising a mixing container, a rotatable mixing agitator and a mixing agitator drive suitable for mixing moulding sand in the mixing container, means for feeding components to be mixed to the mixer, means for supplying hot water or hot water vapour to components in the mixing chamber through a plurality of holes in the agitator facing away from a direction of rotation of the agitator, apparatus for stopping the flows of hot water and vapour to the mixing chamber, means for vacuum sealing the mixing container, means for providing a vacuum in the mixing chamber after the flows are stopped to cool the contents of the mixing chamber and remove moisture by vacuum evaporation, and means for removing mixed components from the mixing chamber.

19. Apparatus according to claim 18, wherein the means for providing a vacuum can provide a vacuum to below the vapor pressure of water.

20. Apparatus according to claim 19, wherein the agitator comprises fins, blades or a wall scraper.

21. Apparatus according to claim 19, wherein the mixing container does not rotate, and orifices are provided through a wall of the container for the addition of hot water vapour and/or water.

22. Apparatus according to claim 18, wherein the mixing container rotates.

* * * * *